US005512047A

United States Patent [19]

Dvorak

[11] Patent Number: 5,512,047

[45] Date of Patent: Apr. 30, 1996

[54] MEDICINE DISPENSING PACIFIER

[76] Inventor: Michael Dvorak, 8485 W. 91st. Ave., Westminster, Colo. 80021

[21] Appl. No.: 365,361

[22] Filed: Dec. 28, 1994

[51] Int. Cl.[6] ..... A61J 7/00; A61J 17/00

[52] U.S. Cl. ..... 604/77; 606/234; 606/236

[58] Field of Search ..... 604/77, 200, 201, 604/206; 606/234–236; 128/206.29

[56] References Cited

U.S. PATENT DOCUMENTS

| | | |
|---|---|---|
| 4,143,452 | 3/1979 | Hakim . |
| 4,896,666 | 1/1990 | Hinkle . |
| 5,123,915 | 6/1992 | Miller et al. . |
| 5,176,705 | 1/1993 | Noble . |
| 5,354,274 | 10/1994 | Demeter et al. . |
| 5,395,392 | 3/1995 | Suhonen . |
| 5,407,437 | 4/1995 | Heimreid . |

FOREIGN PATENT DOCUMENTS

| | | |
|---|---|---|
| 1437033 | 11/1988 | U.S.S.R. . |
| 001854 | 2/1993 | WIPO . |

*Primary Examiner*—C. Fred Rosenbaum
*Assistant Examiner*—Perry E. Van Over

[57] ABSTRACT

An improved medicine dispensing pacifier of unitary construction comprising a pierced hollow nipple fixedly attached to a rigid mouth guard with a hollow interior, a reservoir with an end opening opposite the nipple, fixedly attached to the mouth guard, sealing means operable to seal the reservoir end opening in a fluid-tight manner, and retaining means to fixedly attach the sealing means to the reservoir chamber to eliminate potential choking hazard.

4 Claims, 1 Drawing Sheet

MEDICINE DISPENSING PACIFIER

BACKGROUND—FIELD OF INVENTION

This invention relates to medicine dispensers, specifically to a pacifier for dispensing medicine.

DESCRIPTION OF RELATED ART

Dispensing liquid medication to infants by mouth has always presented a problem for both Parents and Medical Practitioners. Syringes, spoons, and droppers are impractical and inefficient, in that they require a sick and generally uncooperative infant be held and restrained while coaxing or forcing the mouth of the infant open to receive the medication. The result is typically spilled and wasted medication, inaccurate dosages, and upset infants and parents alike.

In the past, various pacifiers with the ability to dispense medicine have been known, however, they all suffer from a number of disadvantages. Wallace et at. U.S. Pat. No. D326,151 (1992) describes a design for a medicine dispensing pacifier which requires a separate syringe to inject medicine in to the pacifier, has no air-tight seal on the end opposite the ripple, which lows air to enter the medicine reservoir and allows for the possibility of leakage, has no simple method of cleaning and is of a shape and structure likely to be unfamiliar to an infant and thus, likely to be rejected. Maradey-Collazo U.S. Pat. No. D338,732 (1993) describes an ornamental design for a combined pacifier and medicine dispenser, which requires a separate syringe to inject medicine in to the pacifier, has no air-tight seal on the end opposite the nipple, which allows air to enter the reservoir and allows for the possibility of leakage, has no simple method of cleaning, is of a shape and structure likely to be unfamiliar to an infant and thus likely to be rejected, and is of a multi-piece construction which adds cost and complexity to the manufacturing process. Mailot et al. U.S. Pat. No. 5,127,903 (1992) describes a device for delivering medicaments to infants which is designed for small, continuous dosages delivered over long periods of time. Mac Vane U.S. Pat. No. 5,013,321 (1991) describes a gel dispensing pacifier which requires a separate dispenser for the introduction of gel in to the pacifier, has threadably engaged sealing means which comprise a separate cap which introduces the possibility of accidental disassembly and thus presents a choking hazard, and is of a multi-piece construction which adds cost and complexity to the manufacturing process. Miller et at. U.S. Pat. No. 5,123,915 (1992) describes a device for the oral administration of a medication, comprising an at least four piece construction with a separate nipple, mouth guard, reservoir, and separate cap which adds cost, complexity and additional manufacturing steps which adds potential for manufacturing defects and thus, increases potential safety hazards. The separate cap is threadably engaged to the reservoir body, which requires a separate safety cap construction to operate, which adds complexity to operation, and, because the separate cap is threadably engaged, the cap requires rotation to seal, and thus can not be fixedly attached to the reservoir body, and thus always presents a potential for removal and subsequent choking hazard. Lastly, because the cap is not fixedly attached to the pacifier, presents for the possibility of loss of the cap, rendering the unit inoperable. Noble U.S. Pat. No. 5,078,734 (1992) describes an infant pacifier constructed in a manner to confine and administer medicine which has an at least three piece construction with a separate nipple, mouth guard, and cap which adds cost and complexity to the manufacturing process and potential for defects and thus increases potential safety hazards. The separate nipple and cap are not fixedly attached to the mouth guard, which is a potential safety hazard through accidental removal and subsequent ingestion of the nipple, and thus would require additional child-proof cap construction, adding cost and complexity and increasing difficulty of operation. Lastly, the nipple and cap, because they are not fixedly attached to the mouth guard, requires the engagement of the cap to retain the nipple, posing a grave safety hazard, in that a slight rotation of the cap will release the nipple from the pacifier and potentially choke an infant.

SUMMARY OF THE INVENTION—OBJECTS AND ADVANTAGES

Accordingly, several objects and advantages of the present invention are:

A) to provide a medicine dispensing pacifier which can be easily filled with medicine without requiring a separate syringe or device for the injection of medicine;

B) to provide a medicine dispersing pacifier which can be scaled after filling with medicine, which reduces the potential for leakage;

C) to provide a medicine dispensing pacifier which can be easily, quickly, and effectively cleaned and re-used;

D) to provide a medicine dispensing pacifier with a shape, size, and structure familiar to an infant, which reduces the potential of rejection by an infant;

E) to provide a medicine dispensing pacifier of a unitary construction, which comprises a nipple, a reservoir, a mouth guard, a plug type closing device, and flexible retaining means, which, because the plug is telescoped in to the reservoir, rather than relying upon threadable engagement, can be molded as a unitary piece, of a single material, which can therefore be manufactured as a unitary piece, which reduces manufacturing complexity and thus manufacturing cost;

F) to provide a medicine dispensing pacifier of a unitary construction which relies upon a plug telescoped in to the medicine reservoir, rather than relying upon threadable scaling which requires rotation of the cap, so that, became the plug does not require rotation to seal, can be fixedly attached to the medicine reservoir wall, and thus will eliminate the possibility of loss of the plug, and thus eliminates any potential choking hazard, as well as any loss of a separate cap which would render the pacifier inoperable.

Further objects and advantages are to provide a medicine dispensing pacifier which can be used easily and conveniently to dispense liquid medication, which reduces the potential for leakage, which has a familiar size, shape and structure, which can be easily cleaned, which is of a unitary construction of a single material, which is inexpensive to manufacture and simple to operate, which relies upon a plug telescoped in to the reservoir to seal, which can be fixedly joined to the reservoir body and eliminate any potential choking hazards that would result from the removal of a separate cap, and which eliminates the potential loss of a separate cap which would render the unit inoperable. Still further objects and advantages will become apparent from a consideration of the ensuing description and drawings.

REFERENCE NUMERALS IN DRAWINGS

10—nipple opening
12—nipple
14—mouth guard opening
16—mouth guard
18—reservoir chamber
20—closeable reservoir opening
22—retaining means
24—closing means

DESCRIPTION OF THE INVENTION

Figure 1:
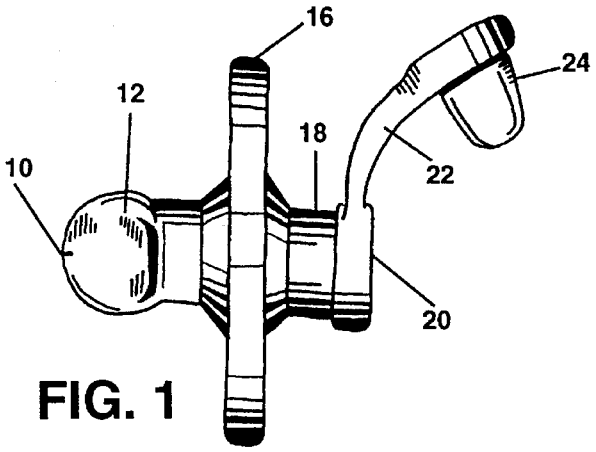
FIG. 1 is a top plan view of the unitary nipple, mouth guard, reservoir, sealing means, and flexible retaining means of the present invention.
Figure 2:
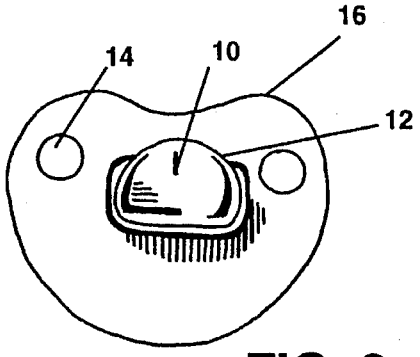
FIG. 2 is a front view of the nipple and mouth guard.

A typical embodiment of the pacifier of the present invention is illustrated in FIG. 1 (top plan) and FIG. 2 (front view) illustrating the nipple opening (10) nipple (12) mouth guard opening (14) mouth guard (16) reservoir chamber (18) closeable reservoir opening (20) retaining means (22) and closing means (24). A typical embodiment of the pacifier of the present invention is of a unitary construction, integrally molded from any number of vinyls, latex, robbers, or rubberized plastics, of sufficient flexibility to provide a pliable nipple (12) and of sufficient rigidity to provide a semi-rigid mouth guard (16) in the appropriate thickness to meet current safety standards and requirements. A preferred embodiment of the pacifier is a unitary molded construction of clear vinyl, although any number of vinyls, latex, robbers, or rubberized plastics utilized in the art may be used.

Figure 3:
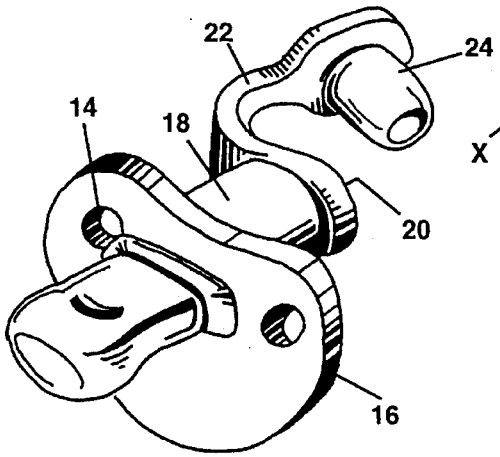
FIG. 3 is a perspective view, showing the front of the pacifier of the present invention in an unsealed condition.
Figure 4:
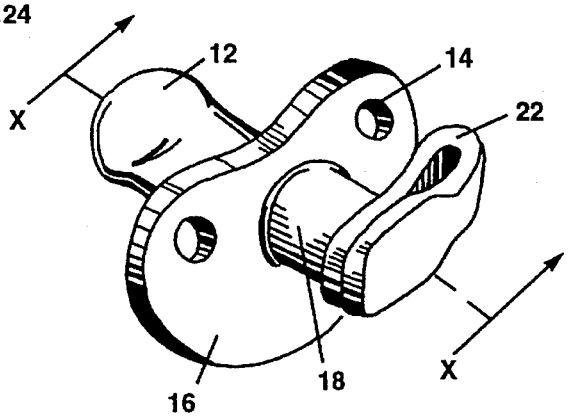
FIG. 4 is a perspective view, showing the rear of the pacifier of the present invention in a sealed condition.

FIG. 3 (front perspective) and FIG. 4 (rear perspective) illustrate typical embodiments of the pacifier of the current invention. The nipple (12) is pierced with at least one nipple opening (10) of sufficient size to deliver a preferred flow of medication. The nipple (12) is illustrated in an oval flattened form in accordance with the NUK nipple, U.S. Pat. No. 2,520,773; additional embodiments may include a variety of nipple shapes known in the art.

The nipple (12) has an open base to the mouth guard (16) and is integrally molded to the mouth guard (16). Further embodiments of the nipple (12) and reservoir chamber (18) may have integrally molded measurement traits at spaced intervals orthogonal to the mouth guard (16).

The mouth guard (16) has an interior open to the nipple (12) and reservoir chamber (18). In a typical embodiment the mouth guard (16) has two mouth guard openings (14) FIG. 2, and is of sufficient rigidity to meet current safety standards. The mouth guard (16) is integrally molded to the reservoir chamber (18).

The reservoir chamber (18) has an open interior with an open base to mouth guard (16) and has an outer wall member defining closeable reservoir opening (20). The reservoir chamber (18) is of sufficient rigidity to provide a fluid-tight seal when engaged with closing means (24). The reservoir chamber (18) is integrally molded to the retaining means (22). The closeable reservoir opening (20) is of dimensions sufficient to receive a dosage of medication, as for example from a spoon, eyedropper, or directly from a medicine bottle or container. The closeable reservoir opening (20) is of size sufficient to provide a fluid-tight seal in conjunction with closing means (24). The closeable reservoir opening (20) is of sufficient dimensions to allow the introduction of water for cleaning purposes.

The retaining means (22) is of sufficient dimensions to facilitate retaining closing means (24) and to allow closing means (24) to seal closeable reservoir opening (20) in a fluid-tight manner. Retaining means (22) is integrally molded to closing means (24). Further embodiments of retaining means (22) may protrude from closing means (24) to facilitate removal of closing means (24) from closeable reservoir opening (20).

Closing means (24) is of a sufficient dimension to seal closeable reservoir opening (20) in a fluid-tight manner. In a typical embodiment, closing means (24) has a hollow interior to accommodate air and/or medication when sealing. Further embodiments may include an air passage in closing means (24). Closing means (24) is integrally molded to retaining means (22).

Figure 5:
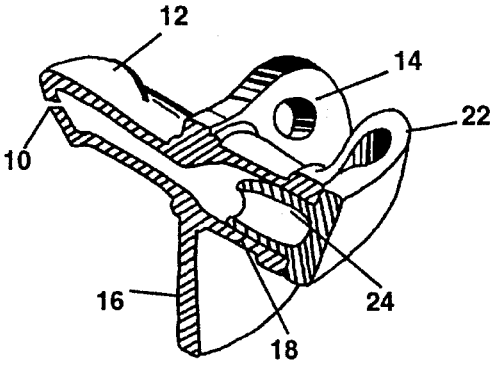
FIG. 5 is a section taken on line X—X in FIG. 4.

FIG. 5 (section through) further illustrates a typical embodiment of the pacifier of the current invention. The nipple opening (10) is preferably located near the tip of the nipple (12). The nipple (12) is hollow and has an open base to mouth guard (16). The nipple (12) is integrally molded to the mouth guard (16). Mouth guard (16) has an open interior to the nipple (12) and the reservoir chamber (18). Mouth guard (16) is integrally molded to reservoir chamber (18). Closeable reservoir opening (20) is formed by the termination of the reservoir chamber (18) and is of dimension sufficient to receive a dosage of medication and allow the introduction of water for cleaning. The closeable reservoir opening (20) is of size sufficient to provide a fluid-tight seal with closing means (24). Retaining means (22) is of sufficient dimension to facilitate retaining closing means (24) and to allow closing means (24) to seal closeable reservoir opening (20) in a fluid-tight manner. Closing means (24) preferably has a hollow interior to accommodate air and/or medication when sealing. Further embodiments may include an air passage in closing means (24).

From the description above, a number of advantages of my medicine dispensing pacifier become evident:

A) no special or additional syringes or eyedroppers arc required to fill the pacifier with medicine;

B) the pacifier can be sealed in a fluid-tight manner to reduce the potential for leakage;

C) the closeable reservoir opening provides an easy and effective way to clean the pacifier after dispensing medication;

D) the pacifier has a shape, size, and structure typical of non-medicine dispensing pacifiers, thus providing a familiar, comfortable form to an infant, reducing the possibility of rejection;

E) the unitary molded construction of a single material provides a medicine dispensing pacifier which requires no assembly and reduces manufacturing costs; and F) the unitary construction provides dosing means comprising closing means which are telescoped in to the closable reservoir opening, rather than a threadably engaged seal which requires rotation, and thus closing means can be fixedly attached to the reservoir chamber which eliminates the safety hazard posed by a separate cap, and eliminates the possibility of the loss of a separate cap which would render the unit inoperable.

OPERATION

Figure 6:
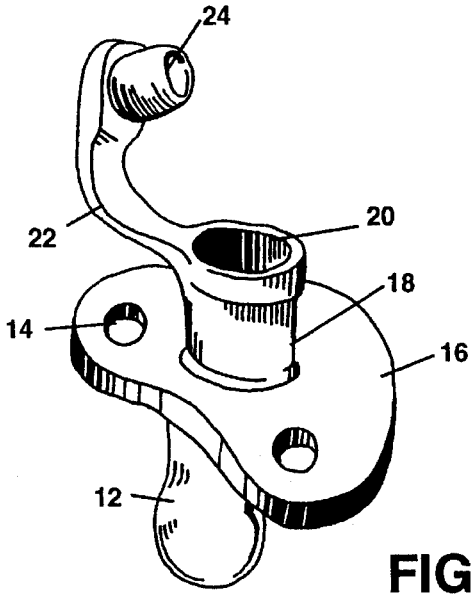
FIG. 6 is a perspective view showing the rear of the pacifier of the current invention in a preferred embodiment of use.

The manner of using the medicine dispensing pacifier of the present invention is as follows: lust, one prepares a formulation of medication in a spoon, eyedropper, or directly from a medicine bottle or container. Next, one inverts the entire pacifier (FIG. 6) downward such that the mouth guard (16) is in a horizontal position. Next, one pours the medication in to the closeable reservoir opening (20) whereby the medication flows in to the nipple (12) and the reservoir chamber (18). Next, one inserts closing means (24) in to the closeable reservoir opening (20). The closing means (24) is inserted fully to the point at which the retaining means (22) is in contact with the reservoir chamber (18), thus creating a fluid-tight seal (FIG. 4). A sectional view of the fluid-tight relationship between closing means (24) and reservoir chamber (18) can be seen in FIG. 5. The entire pacifier unit (FIG. 4) can then be placed in an infant's mouth, preferably with the infant in a semi-upright position. (Recommended by Pediatricians to keep fluids from flowing in to the infant's inner ear). Once an infant has ingested the medication, the pacifier may be removed from the infant's mouth. Next, one removes the closing means (24) from the reservoir chamber (18) (FIG. 3). lifts facilitates the entry of water in to the closing means (24) the reservoir chamber (18) and the nipple (12) which allows for a thorough and sanitary cleaning in preparation for the next use.

Accordingly, the reader will see that tile medicine dispensing pacifier of the current invention can be easily filled with medicine without requiring any special syringes, eyedroppers, or any other injection means, can be sealed in a fluid-light manner after filling with medication, can be quickly and easily cleaned for re-use, has a size and shape familiar to infants and thus is likely to be accepted, is of a unitary construction of a single material which lowers manufacturing costs and complexity, and which utilizes closing means telescoped in to the closeable reservoir opening to seal without threadable engagement and thus can be fixedly attached to the reservoir wall, which eliminates the potential safety hazard of a separate cap and further prevents the loss of a separate cap which would render the unit inoperable.

Although the above description contains many specificities, they should not be construed as limiting the scope of the invention but merely providing illustrations of the presently preferred embodiments of the present invention. For example, the nipple may have any number of shapes currently known in the art. The pacifier may be manufactured of any number of vinyls, latex, rubbers, or rubberized plastics, and the reservoir chamber and nipple may have integrally molded measurement indicators of any desired measurement units. Thus the scope of the patent should be determined by the appended claims and their legal equivalents, rather than by the examples given.

I claim:

1. A pacifier for the administration of liquid medication, said pacifier comprising:

a pierced, hollow nipple having a nipple reservoir bounded in part by pierced distal and open proximal extremities, a reservoir, fixedly attached to said open proximal extremity of said nipple, said reservoir having an outer wall member defining a reservoir chamber, a first end opening in to said nipple chamber, and a closeable second end opening, a rigid planar mouth guard having a hollow interior, said mouth guard fixedly attached to said outer wall member defining a reservoir chamber disposed orthogonally to said nipple and said closeable second end opening, closing means operable to seal said closeable second end opening of said reservoir, said closing means comprise a plug having an axial inner end, an axial outer end and a side wall sized to be telescoped in to said closeable second end opening of said reservoir in a fluid tight relationship, flexible retaining means to fixedly attach said closing means to said outer wall member defining a reservoir chamber, said flexible retaining means fixedly attached to said axial outer end of said plug, whereby medicine can be dispensed using a pacifier with a closeable end opening sealed by a plug which can be fixedly attached to the pacifier body to eliminate loss and potential choking hazard.

2. The device of claim 1 in which said closeable second end opening of said reservoir is of dimensions sufficient to receive a dosage of medication.

3. The device of claim 1 in which said pacifier comprises a unitary construction of elastic materials.

4. The device of claim 3 wherein said elastic material is vinyl.

* * * * *